US009835409B2

(12) United States Patent
Munz

(10) Patent No.: US 9,835,409 B2
(45) Date of Patent: Dec. 5, 2017

(54) POCKET CARRIED HOLSTER

(71) Applicant: David James Munz, Philadelphia, PA (US)

(72) Inventor: David James Munz, Philadelphia, PA (US)

(73) Assignee: David Munz, Philadelphia, PA (US)

( * ) Notice: Subject to any disclaimer, the term of this patent is extended or adjusted under 35 U.S.C. 154(b) by 0 days.

(21) Appl. No.: 15/266,407

(22) Filed: Sep. 15, 2016

(65) Prior Publication Data

US 2017/0160051 A1 Jun. 8, 2017

Related U.S. Application Data

(60) Provisional application No. 62/283,905, filed on Sep. 15, 2015.

(51) Int. Cl.
*F41C 33/02* (2006.01)
*A45F 5/02* (2006.01)
*F41C 33/04* (2006.01)

(52) U.S. Cl.
CPC ..... *F41C 33/0209* (2013.01); *F41C 33/0245* (2013.01); *F41C 33/0254* (2013.01); *F41C 33/041* (2013.01); *F41C 33/048* (2013.01); *A45F 5/022* (2013.01); *A45F 2200/0591* (2013.01); *Y10S 224/912* (2013.01)

(58) Field of Classification Search
CPC ..... F41C 33/048; F41C 33/0236; F41C 33/0245; A45F 5/022; A45F 2200/0591; Y10S 224/912
See application file for complete search history.

(56) References Cited

U.S. PATENT DOCUMENTS 837,156 A * 11/1906 Townsend ..... F41C 33/0209 224/182
881,044 A * 3/1908 Audley ..... F41C 33/0209 224/230
896,004 A * 8/1908 Gaskill ..... F41C 33/0209 224/230
932,346 A * 8/1909 Stewart ..... A45F 5/022 2/250
1,120,190 A * 12/1914 Gaskill ..... F41C 33/0209 224/230
1,886,718 A * 11/1932 Noel ..... A45F 5/022 2/250
1,887,780 A * 11/1932 Noel ..... A45F 5/022 224/230
2,434,380 A * 1/1948 Williams ..... A45F 5/021 224/243
2,777,180 A * 1/1957 Keating ..... A45F 5/022 24/3.6
3,583,611 A * 6/1971 Theodore ..... F41C 33/0227 224/250
3,894,667 A * 7/1975 Baldocchi ..... A45F 5/02 224/198

(Continued)

*Primary Examiner* — Justin Larson

(57) ABSTRACT

A pocket carried holster of modest outer dimension and novel design is secured to the outer extents of the front pocket in a pair of pants to facilitate the discrete carry of a small caliber semiautomatic pistol and a spare ammunition magazine such that both can be safely removed from the pocket's confines in an expedited manner without snagging on the garment.

7 Claims, 8 Drawing Sheets

(56) References Cited

U.S. PATENT DOCUMENTS 4,450,992 A * 5/1984 Casull ..... A44B 11/005 224/163
4,466,537 A * 8/1984 McMahan ..... F41C 33/0218 206/3
5,100,036 A * 3/1992 Rogers ..... F41C 33/0209 224/193
5,421,497 A 6/1995 Gilmore
5,611,471 A * 3/1997 French ..... F41C 33/008 224/243
5,662,219 A * 9/1997 Tschudy ..... A45C 13/02 150/113
D385,108 S * 10/1997 Tschudy ..... D3/262
5,687,891 A * 11/1997 Beletsky ..... F41C 33/0227 224/243
5,749,507 A * 5/1998 Wood ..... F41A 23/18 224/255
6,112,962 A * 9/2000 Matthews ..... F41C 33/0236 224/191
6,402,001 B1 6/2002 Madarang
8,505,170 B1 * 8/2013 Gray ..... A45F 5/021 24/3.12
8,511,508 B1 * 8/2013 Glover ..... A45F 5/022 150/133
9,109,857 B2 8/2015 Kendrick
9,170,064 B2 10/2015 Rogers
9,261,328 B2 2/2016 Sitz
9,297,612 B2 3/2016 Schmadeka
2009/0107865 A1 * 4/2009 Tsai ..... F41C 33/0236 206/317
2013/0082079 A1 * 4/2013 Malucky ..... F41C 33/0236 224/575
2013/0180144 A1 * 7/2013 Kresser ..... F41C 3/00 42/1.05
2016/0209164 A1 * 7/2016 Fravala ..... F41C 33/046
2016/0216064 A1 * 7/2016 Rossi ..... F41C 33/048
2017/0100847 A1 * 4/2017 Benton ..... B26B 29/025
2017/0160051 A1 * 6/2017 Munz ..... F41C 33/0209
2017/0211908 A1 * 7/2017 Rocque ..... A41D 1/02

* cited by examiner

POCKET CARRIED HOLSTER

CROSS-REFERENCE TO RELATED APPLICATIONS

This application claims the benefit of provisional patent application Ser. No. 62/283,905, filled on Sep. 15, 2015 by the present inventor.

FEDERALLY SPONSORED RESEARCH

None.

SEQUENCE LISTING

None.

BACKGROUND OF THE INVENTION

This invention facilitates the carry of a firearm in the pocket of an article of clothing in such a manner that the device is easily and safely accessible from the pocket by virtue of the holster maintaining the firearm in a consistent location in the pocket. The rigid holster of the most minimal outer dimensions further facilitates removal of the firearm from the pocket by extending the pocket's sides so they do not impede the firearm's removal. Additionally, the holster's geometry shields the firearm's trigger and assists in the placement of a finger behind the trigger to assure against accidental discharges. A cavity in the holster accommodates a space ammunition magazine which is moved to the center of the holster for easy retrieval when the firearm is removed from the holster.

DETAILED DESCRIPTION OF THE INVENTION

Firearm holsters for the concealed carry of firearms have traditionally been manufactured from flexible materials such as leather, synthetic fabric, rubber, and flexible plastic sheet which allow the holster to flex as the wearer moves to improve the wearer's comfort, agility, and to disguise the "print" or easily distinguishable outline of a firearm as would be seen when the wearer's clothing drapes itself over a bare firearm.

The lack of guns sufficiently small to fit in a pocket and with the capability of holding and firing a sufficient number of rounds of ammunition to be of use to most concealed carry proponents precluded the pocket carry of most firearms. Larger firearms, traditionally popular with most concealed carry practitioners were typically carried inside the waist band or outside of the pants, and in either instance beneath a draped over shirt. Flexible holsters function admirably in these applications.

The recent manufacture of semi-automatic handguns that carry 6+ rounds of 380 ammunition in a minute package tiny enough to fit in the pocket of most common denim jeans created the need for a new type of holster to meet radically different performance criteria's that cannot be attained by the adaptation of traditional flexible holsters to pocket carry applications.

A novel holster of the most minimal dimension and crafted from appreciably rigid material is necessary to facilitate the carry of these new weapons in the relatively small pockets of traditional jeans. The tight fit of jean pockets in conjunction with the movement of the wearer work to distort the dimensions of flexible pocket holsters which can impede the removal of firearms from those holsters. Additionally, the geometry of the pocket itself and excess garment material in close proximity to the pocket can also stymie the removal of the firearm from the pocket. The rigid holster mitigates this by holding the pocket open which tensions fabric which would otherwise flow loosely and catch on the firearm's geometry.

Since pockets do not have universal internal geometry, traditional pocket holsters do not sit at a consistent height in pockets of different depth making the prompt removal of firearms from them an inconsistent and thus difficult and dangerous proposition. Holsters sometimes even significantly alter their orientation in the pocket as there is often sufficient room to do so. Firearms may even invert themselves inadvertently to face the wearer. The rigid holster however is fastened by two clips to the top of the garment pocket so its orientation is consistent regardless of the size of the pocket or how the wearer of the garment might move.

Some pocket holsters make no effort to cover the trigger of the firearm or only cover it in such a manner that a finger inside of the garment pocket can easily slide between the flexible holster and the firearm and directly contact the front surface of the trigger risking the accidental discharge of the weapon. Both of these scenarios present obvious safety hazards. The rigid holster covers the area in front of the trigger with a rigid member that cannot be distorted to access the front surface of the trigger while the firearms is full secured in the holster. This is a definite improvement over all flexible pocket holsters. Furthermore, a recess in the rigid member covering the area in front of the trigger works to guide a finger to the area behind the trigger. Thus, when an individual removes the firearm from their pocket they do so with a finger behind the trigger of the firearm. Since the firearm cannot be fired with a finger filling the space behind the trigger. This presents a significant safety improvement over traditional pocket holsters.

A recess is formed between the plates surrounding either side of the trigger guard. Since the trigger guard is thinner than the body of the firearm the plate do not to the overall thickness of the firearm holster assembly but additional ammunition which may be stored in the recess. The ammunition magazine stored in this recess is secured by a long, flexible, spring of sorts which fulfills the dual function of holding the magazine firmly to the center of the holster and allowing the magazine to rotate out of the way when a firearm is inserted into the holster. The dual storage locations optimize pocket space by orienting the magazine at an angle closer to the typical dimensions of the front pocket in a pair of jeans. Upon removal of the firearm the magazine spring orients the spare ammunition magazine so that it assumes a position in the center of the holster and closer to the holster's opening so that it is easier to grasp and extricate from the pocket.

In an effort to keep the firearm holster assembly as effectively thin as possible material is only added where there would be a natural recess between the firearm and the wearer's body. Since the side of the firearm is relatively flat and wearer's leg has a curvature to it, holster material is added only where the firearm and leg would not naturally contact each other. This results in a holster that appears to have a cavity cut in it nearly as large as the side profile of the firearm. Material lower than the underside of the firearm exists only below the top of the firearm's slide and the base of the magazine well. A member running across the back of the firearm is contoured to mimic the shape at the rear of the firearm but with a chamfered, beveled, or radiused edge so that the firearm can be drawn over the member which effectively constrains the firearm into the holster.

An arrangement of a minimum of two clips or spring plungers secure the holster to the outside edges of the pocket so that the orientation of the holster is consistent not just in the pocket its held in but in its orientation to a variety of different pockets regardless of the varying depths, width, or shape of an individual pocket. The use of spring loaded plungers to press against the inside edge of the pocket has the advantage of hiding the use of the holster and protecting the outer fabric of the garment from damage. Traditional clips work fire for securing the holster to the garment but a form of rotatable clip has the advantage of easier installation and less garment damage.

Figure 1:
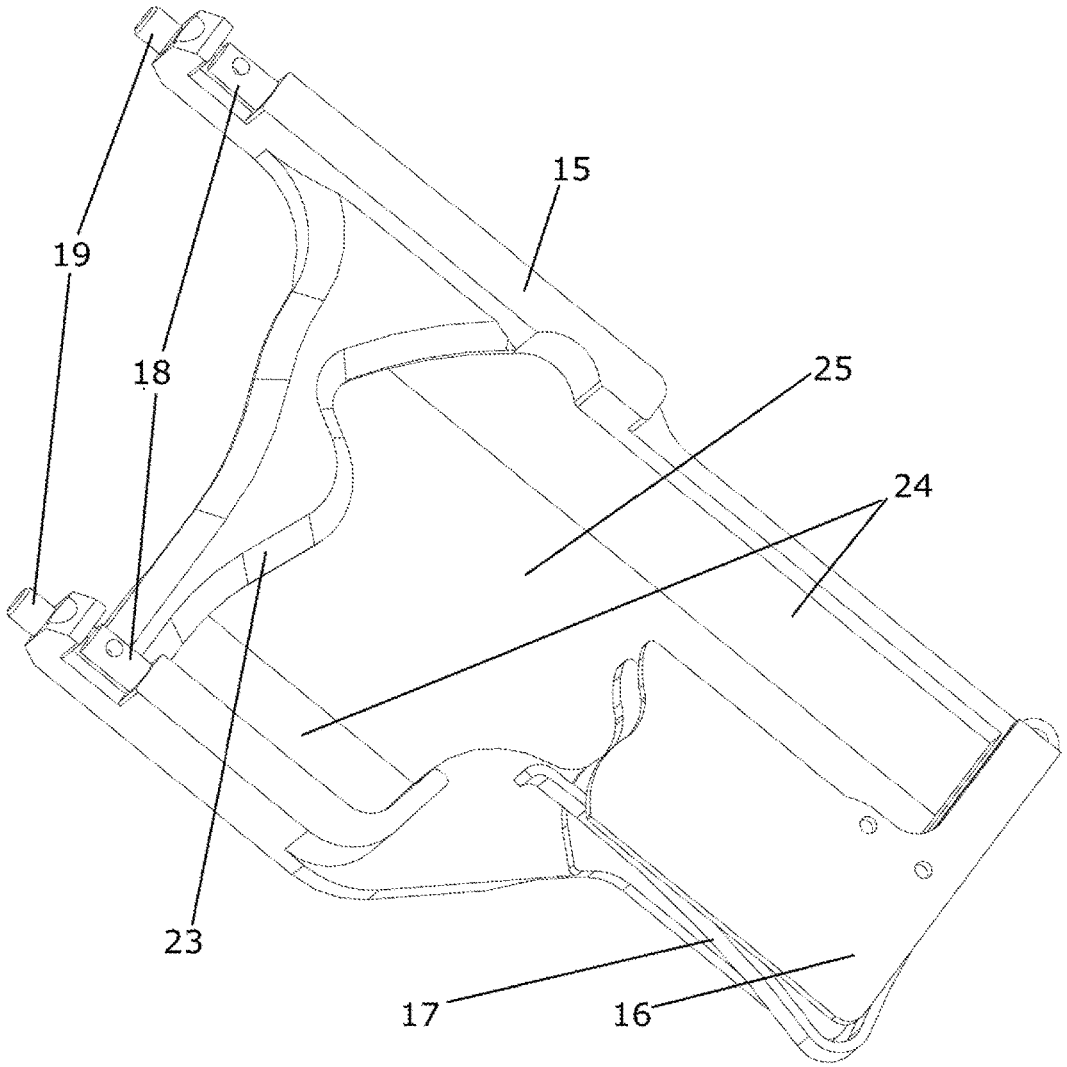
FIG. 1. Top View of Bare Holster

| DRAWINGS-REFERENCE NUMERALS | |
|---|---|
| 2-Rotatable Clips | 11-Pocket Lip |
| 13-Firearm | 15-Frame |
| 16-Top Plate | 17-Magazine Retainer Spring |
| 18-Plungers | 19-Push Button |
| 20-Split Pin | 22-Compression Spring |
| 23-Back Member | 24-Side Member |
| 25-Open Cavity | 26-Crimped Pocket Lip |

DETAILED DESCRIPTION OF THE DRAWINGS

FIG. 1 depicts the rigid holster as it would be configured to sit in the front right pocket of a traditional pair of denim pants. The frame 15 is machined or molded from a single piece of material. Note the open cavity 25 whose shape mimics that of the firearm 13 which would be inserted into the holster. Only the two side wings 24 and some material below firearm's 13 trigger guard prevent the firearm from traveling thru the base of holster's frame 15. A top plate 16 secures to the frame 15 with rivets, screws, or a press fit and provides the dual purpose of keeping the firearm 13 in the holster while also providing the top half of the cavity into which a spare magazine 22 is held. The back member 23 portion of the frame 15 keeps the firearm from sliding out of the holster and adds necessary rigidity to the holster. Note push buttons 19 which are connected to the plungers 18 which are spring loaded to pinch the user's pocket's garment material against the frame 15.

Figure 2:
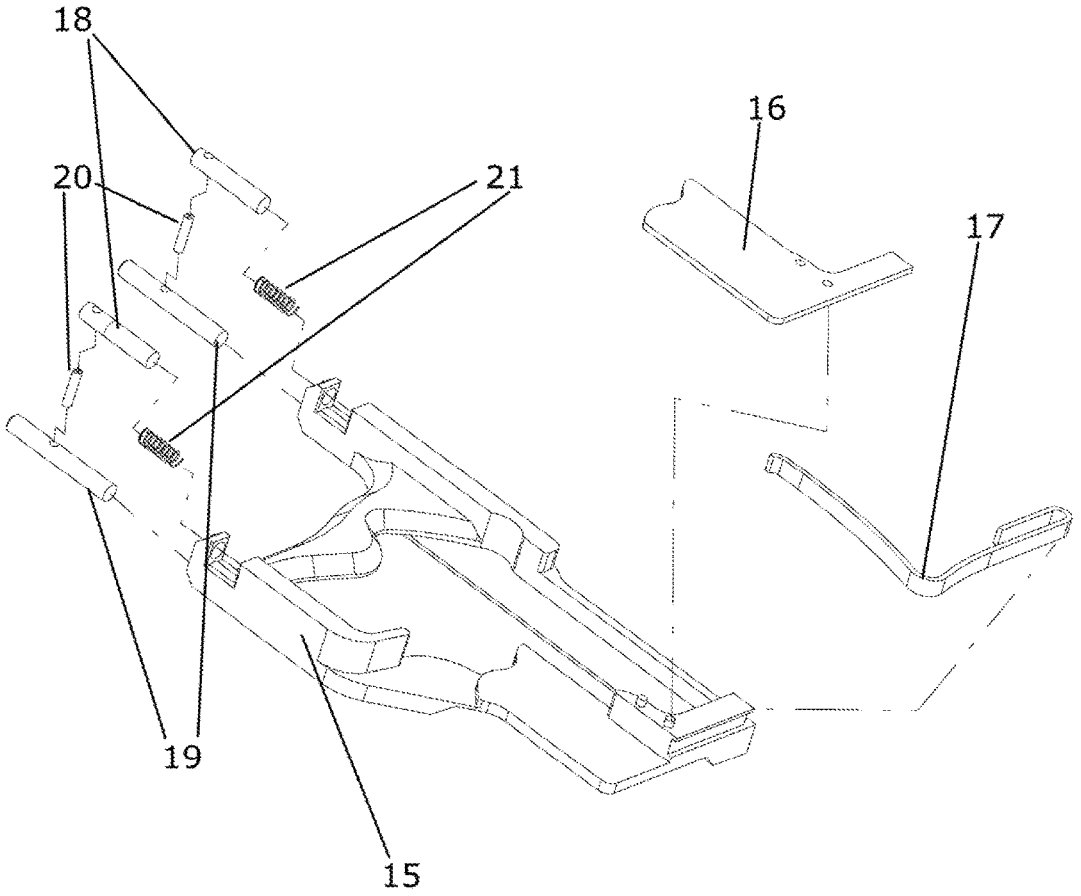
FIG. 2. Exploded View of Bare Holster

FIG. 2 depicts an exploded isometric view of the holster shown in FIG. 1. Note how the flat top 16 presses onto the frame 15. The channel into which the magazine retainer spring 17 retains on the frame 15 is visible. The compression springs 21 which are located deep inside drilled cavities in the frame 15 are exposed. The compression springs 21 press against the plungers 18. split pins 20 connect the plungers 18 to the push buttons 19 which must be pressed to retract the plungers 18. Note cavity generated between top plate 16 and the flat section of the frame 13 above which it presses on. This cavity accommodates a spare ammunition magazine.

Figure 3:
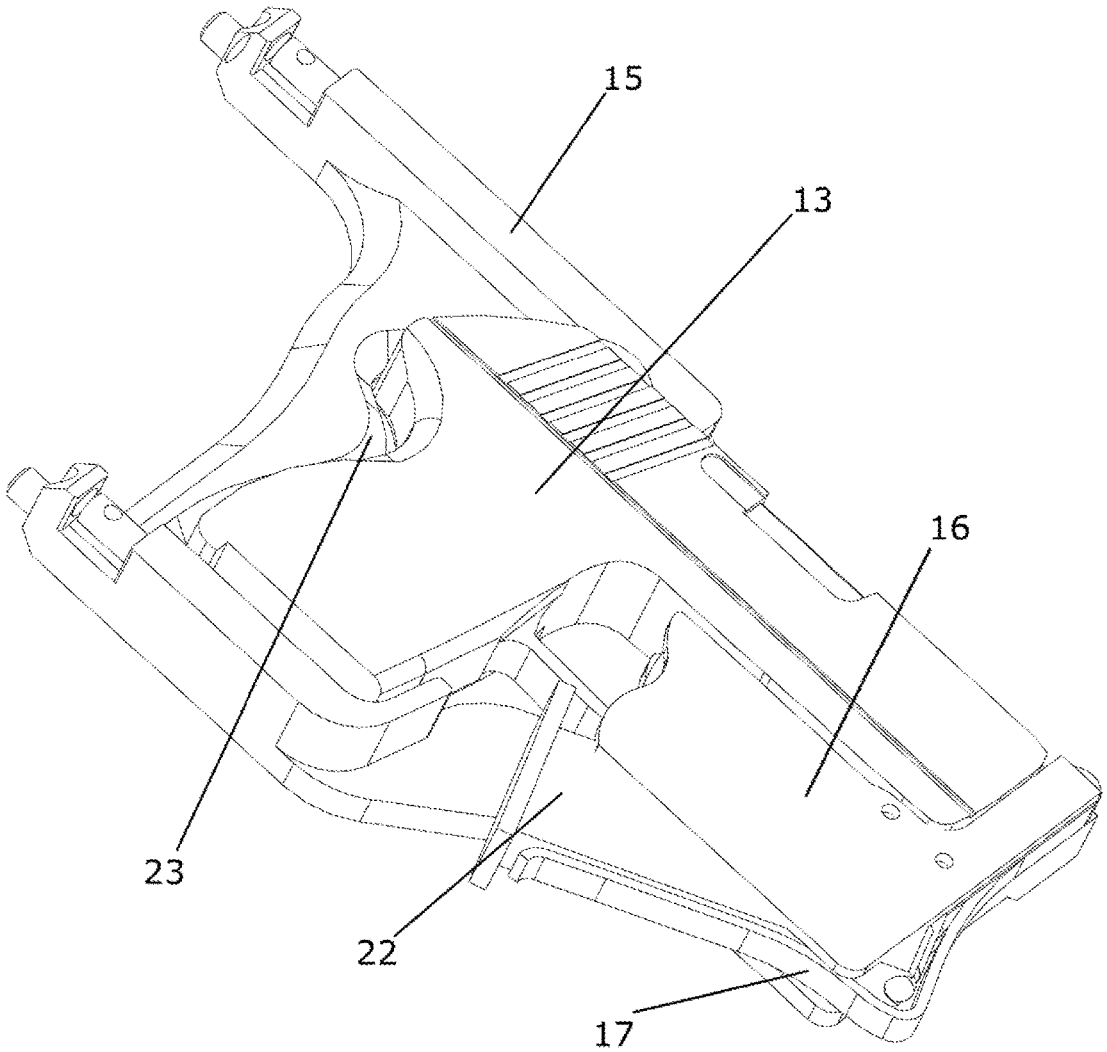
FIG. 3. Top View of Holster with Firearm and Spare Ammo Magazine

FIG. 3 depicts the rigid holster with a firearm 13 installed in it. Note the magazine 22 articulated sideways in the holster as facilitated by the distortion of the magazine retainer spring 17. The magazine rests in the cavity formed between the top plate 16 and the frame below it 15. The back member 23 follows the curve of the rear of the firearm 13. The firearm 13 fits snuggly between all sides of the frame 15 and the top plate 16. Note that the flat top 16 covers trigger of firearm 13 but that area behind trigger and the grip section of firearm 13 is visible. Note that recess in back side of flate top 16 exists to assist user in placing their finger in open cavity.

Figure 4:
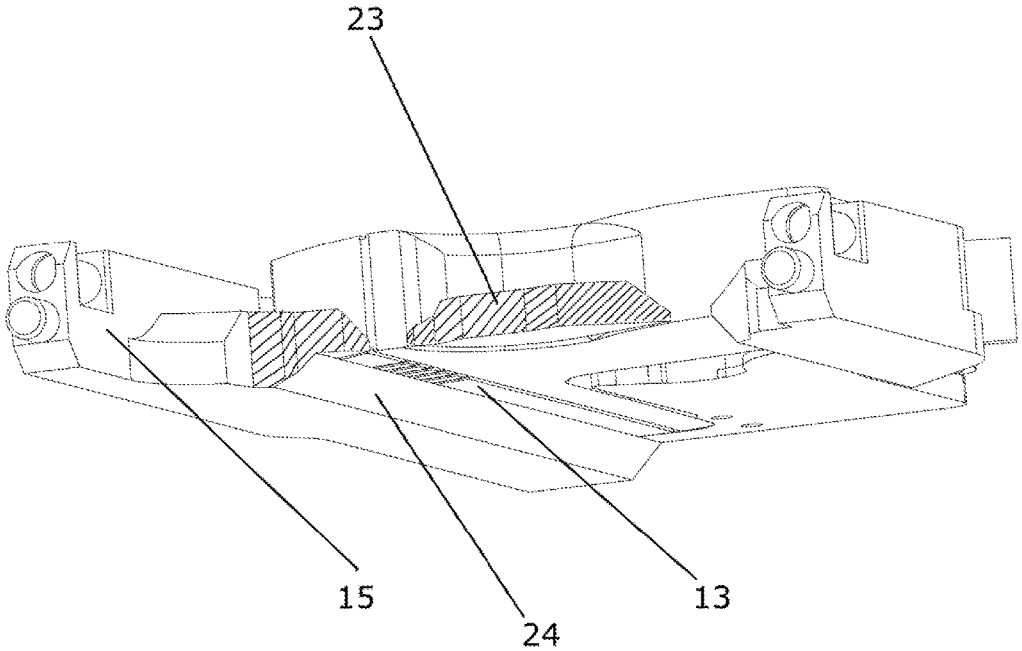
FIG. 4. Rearward View of Underside of Holster with Portions Relieved and Firearm FIG. 5. Front View of Holster, Firearm, and Magazine to Convey Smooth Top Surface FIG. 6. View of Holster Carrying a Spare Ammo Magazine FIG. 7. Holster Constrained in Front Pant's Pocket with Firearm FIG. 8. Holster with Rotatable Clips

FIG. 4 shows a view from the underside of the holster with the firearm 13 installed and portions of the back member 23 relieved to show that the base of the back member 23 is in plane with the lowest side of the firearm 13. The side wings 24 do extend below the plane created by the lowest side of the firearm 13. No other portion of the holster extends beyond the bottom of the firearm 13 for tight fit against a wearer's leg.

Figure 5:
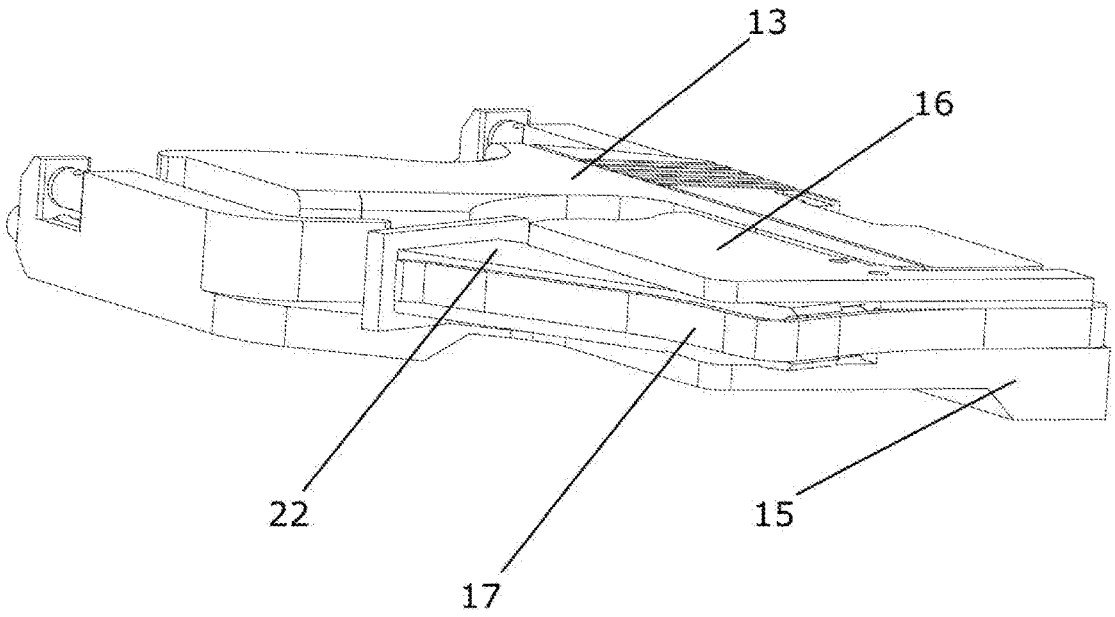

FIG. 5 gives a good view of the relationship between the firearm 13 and the top plate 16 which share an appreciably uniform top surface geometry and lie on a common plane. The top plate 16 covers the firearm's 13 trigger guard and provides a cavity into which the magazine 22 is held by the magazine retainer spring 17.

Figure 6:
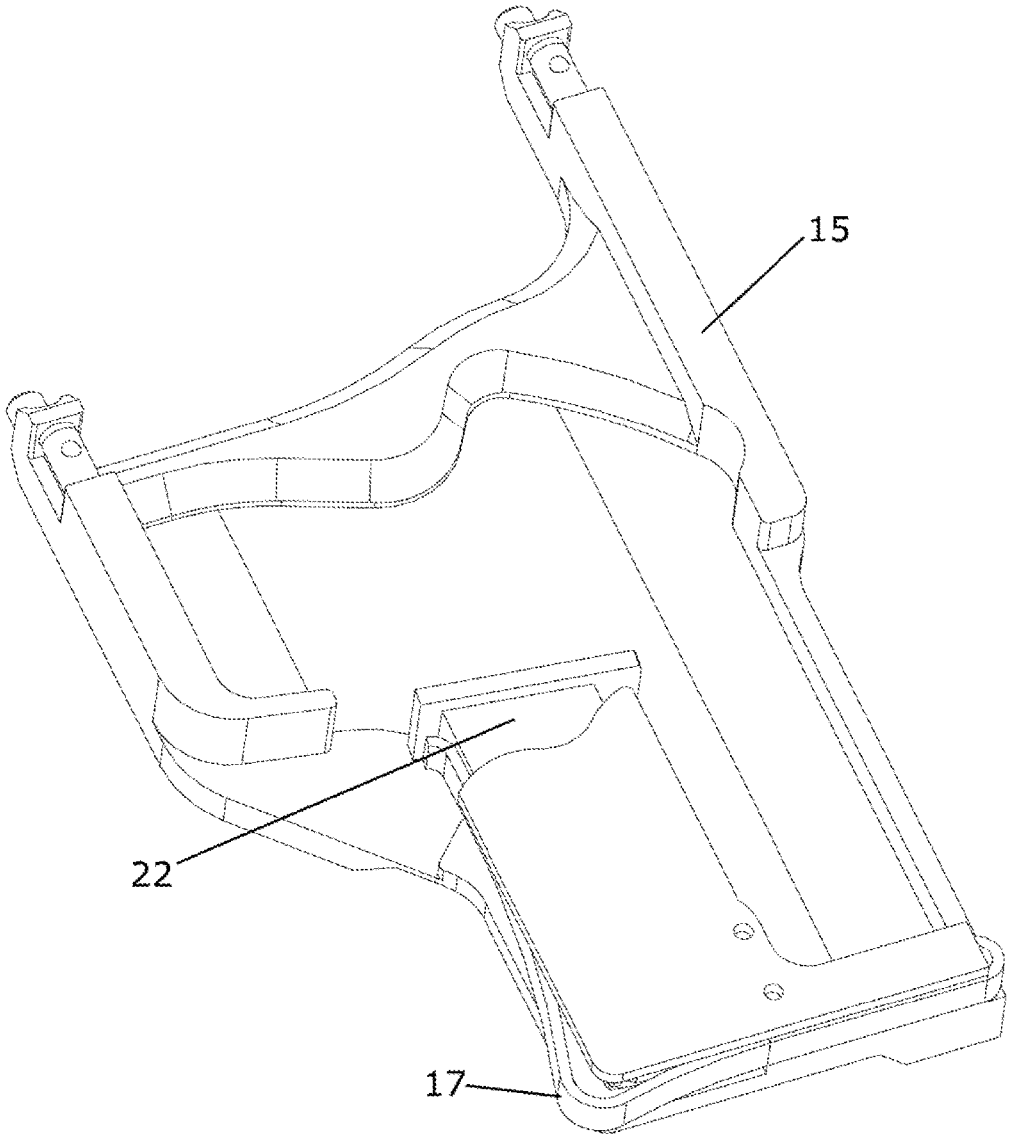

FIG. 6 shows the holster with without a firearm installed but with the magazine 22 held parallel to the top of the holster frame 15 by the magazine retainer spring 17. Note that the end of the magazine 22 is roughly centered in the frame 15 for ease of removal from a theoretical tight pant pocket.

Figure 7:
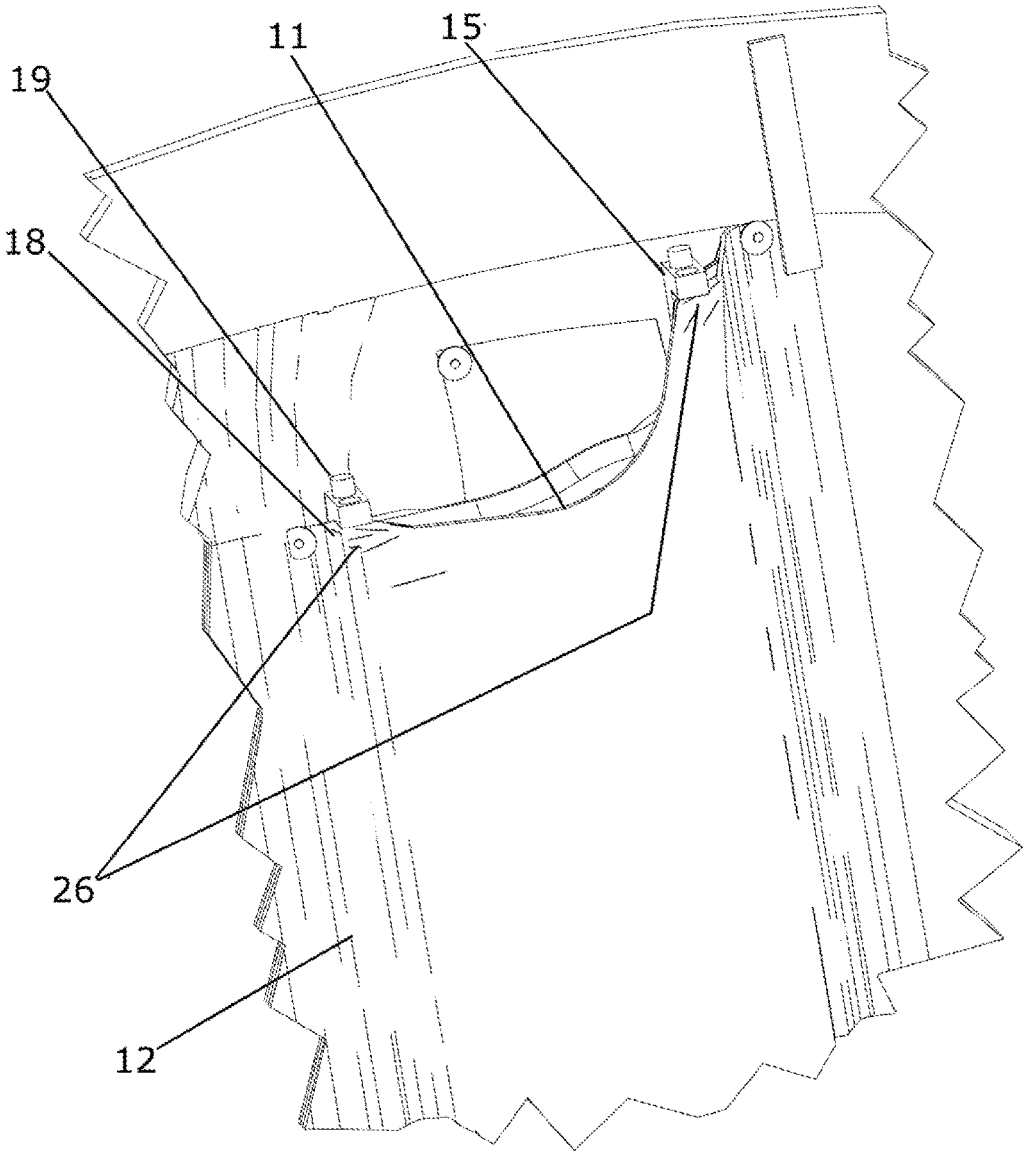

FIG. 7 shows a pair of denim pants 12 surrounding the holster's frame 15 which is barely visible above the pocket lip 11. The crimped pocket edge 26 is pressed by the plunger 18 against the frame 15. Note the push button 19 which actuated the plunger 18.

Figure 8:
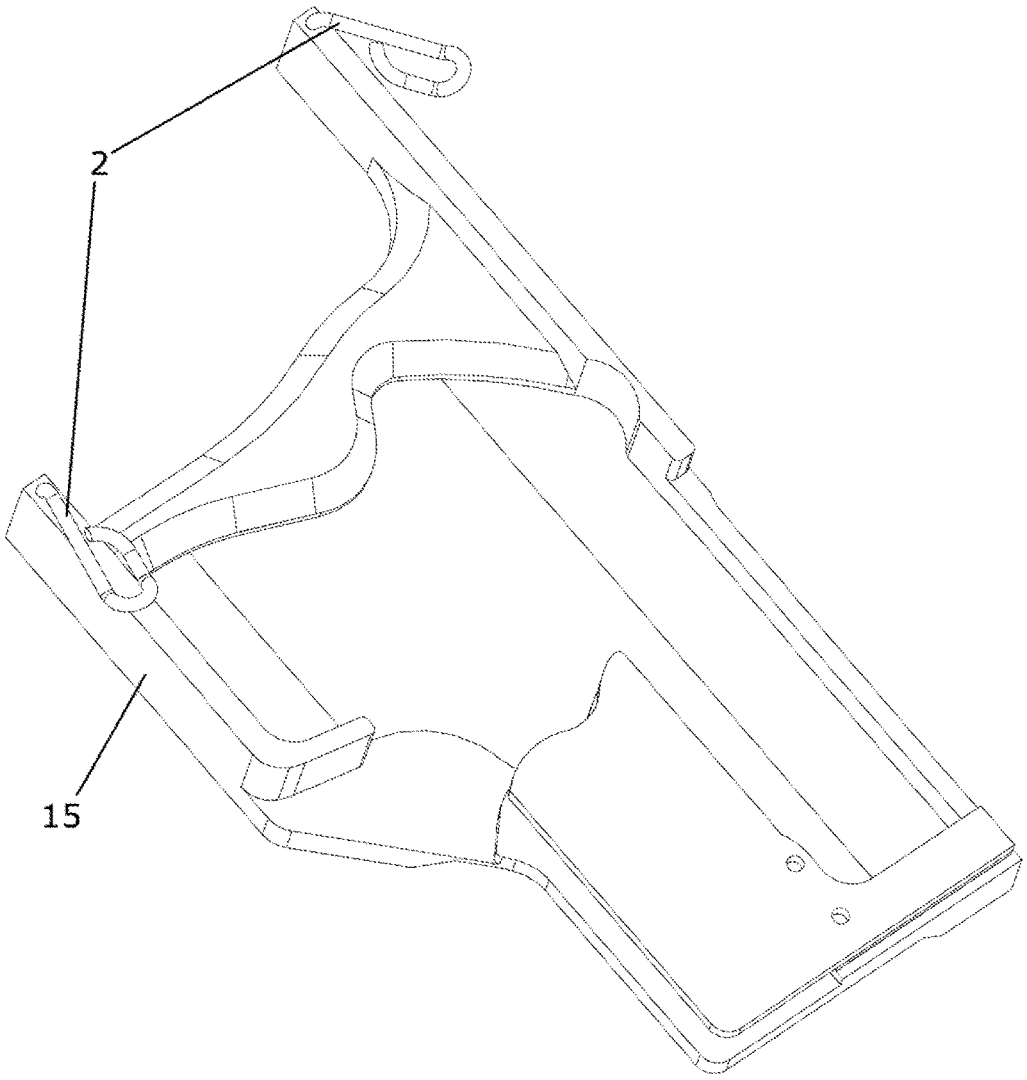

FIG. 8 shows an alternative embodiment of the holster fitted with rotatable clips 2 to clamp against the frame 15. The rotatable clips 2 are ideal for fastening to a frame 15 optimized with thing outer walls which minimizes the overall dimensions of the holster.

I claim:

1. A holster of the sort used to facilitate the carry of a firearm in a pocket of a garment, comprising:

a first wall configured to rest against a top surface of said firearm;

a second wall configured to rest against a bottom surface of said firearm;

a third wall between said first and second walls and configured to rest against a grip of said firearm; wherein said first and second walls extend beyond a length of said firearm to reach a lip of said pocket; and wherein said first and second walls are spaced such that said firearm may travel between them during withdrawal from said holster;

and means for attaching said holster to said pocket.

2. The holster of claim 1, further comprising a top plate that cooperates with said second wall to define a spare ammunition magazine space; wherein a spring secures said magazine within said space and permits movement of said magazine when said firearm is withdrawn from said holster.

3. A holster of the sort used to facilitate the carry of a firearm in a pocket of a garment, comprising:

a first wall configured to rest against a top surface of said firearm;

a second wall configured to rest against a bottom surface of said firearm;

a third wall configured to rest against a grip of said firearm wherein said first, second, and third walls together define a void in a back of the holster such that no holster material exists between said firearm and a user's leg within said void when said holster is in use.

4. The holster of claim 3, wherein said third wall is thinner than a firearm held in said holster and is chamfered, beveled, or rounded such that said firearm may travel over said third wall during withdrawal from said holster.

5. The holster of claim 3, further comprising a top plate that cooperates with said second wall to define a spare ammunition magazine space; wherein a spring secures said magazine within said space and permits movement of said magazine when said firearm is withdrawn from said holster.

6. A holster of the sort used to facilitate the carry of a firearm in a pocket of a garment, comprising:

a holster body including a top plate;

wherein said top plate covers an opening between a trigger guard and front surface of a trigger of said firearm but leaves access to an area between a rear surface of the trigger and a grip of said firearm;

and wherein said top plate includes a recess configured to guide a user's finger into said area during withdrawal of said firearm from said holster.

7. The holster of claim 6, wherein said top plate also cooperates with said second wall to define a spare ammunition magazine space; wherein a spring secures said magazine within said space and permits movement of said magazine when said firearm is withdrawn from said holster.

* * * * *